United States Patent [19]

Ferwerda

[11] 3,992,832

[45] Nov. 23, 1976

[54] STAIRWAY SAFETY SUSPENSION SUPPORT MEANS

[76] Inventor: Thomas Norvin Ferwerda, 888 Park Ave., New York, N.Y. 10021

[22] Filed: May 13, 1976

[21] Appl. No.: 686,227

[52] U.S. Cl. ..... 52/184; 160/332; 105/354

[51] Int. Cl.[2] ..... E04F 11/18

[58] Field of Search ..... 52/173, 182; 160/332; 256/45, 46; 105/354

[56] References Cited

UNITED STATES PATENTS

| | | | |
|---|---|---|---|
| 660,610 | 10/1900 | Yoder | 105/354 |
| 866,812 | 9/1907 | Ries | 105/354 |
| 1,367,928 | 2/1921 | Stolp | 160/332 |
| 3,368,304 | 2/1968 | Ball | 160/332 X |

*Primary Examiner*—John E. Murtagh
*Attorney, Agent, or Firm*—Watson Leavenworth Kelton & Taggart

[57] ABSTRACT

Stairway safety suspension support means that includes overhead means and extending along the stairway above the flight of stairs, from which are suspended successively a plurality of depending loops of flexible strand means with the bottoms of the loops located above the steps less than the heights of people, and also means which dictate that the planes of those loops are oriented generally longitudinally along the stairway.

8 Claims, 4 Drawing Figures

STAIRWAY SAFETY SUSPENSION SUPPORT MEANS

BACKGROUND AND SUMMARY

The present invention concerns the provision of supporting means along a stairway which can be quickly grapsed by a person going up or down to steady himself, which may be in supplement to his grasping a baluster or side rail.

Preferably, this steadying support means is in the form of safety suspension support means that includes relatively fixed overhead structure, which may be a stairhead, and, in any event, extends along the stairway above the flight of stairs therein. A plurality of depending loops of flexible strand means are suspended successively from the overhead structure providing a series thereof with these loops desirably located, in a preferred embodiment, along and substantially in a medial zone of the stairway. Such row of loops has the bottoms thereof located above the steps less than the heights of people who will be going up and down such stairway. Certain means, which may be anchoring devices or structures, dictate that the planes of these loops are oriented generally longitudinally along the stairway, at least within a central longitudinal zone of the latter while leaving clear longitudinal zones flanking opposite sides of this central zone, e.g., intervening the latter and hand rails on opposite sides of this central zone.

It is a general object of the present invention to provide in a simple and economical manner such a safety structure which may be readily installed without demanding any great skill and expensive equipment, while being capable of pleasing appearance after installation and quickly grasped by a descending or ascending person who may stumble and tend to risk falling in going down or up the stairway.

The applicant is not aware of any prior proposal that is pertinent to the present invention. However, he knows of the old U.S. Pat. No. to Ries No. 866,812 of Sept. 24, 1907, in which a vehicle designed for transport of people, such as a streetcar that travels along a track of a pair of transversely spaced rails, is equipped interiorly with longitudinal, overhead, hand rods from which hand-graspable, flexible, suspension loops depend for passengers to grasp for steadying themselves, while standing, against the swaying and accelerating and decelerating motions of the car. The proposals of that disclosure are not adapted to help people to avoid falling on a flight of stairs while ascending or descending.

In accordance with the teachings of the present invention the stairway is equipped with a row of successive depending loops with the planes thereof extending generally longitudinally to assure retention of a clear path up and down the stairway for people to ascend and descend without such loops interfering with such movements, but being readily available to the grasp of any such person who may tend to stumble while climbing or descending. If the stairway has a stairhead the top ends of such depending loops are anchored thereto in any suitable manner, such as by an elongated beam structure extending longitudinally along the flight of stairs and fastened to the stairhead. If desired one leg of each loop may be anchored to one side of the anchoring beam and the other leg to the opposite beam side with the anchored ends spread appreciably along the beam so as to assure easy grasping access to each such loop.

Another object of the invention is to provide a considerable number of such widespread loops and to lap them relative to each other whereby the depending legs thereof are located at frequent intervals for ready availability to the grasps of the stair climbers.

A further object is to provide loop leg top end anchorages of a releasable and adjustable type whereby a single length of the looping strand may be employed without requiring cutting thereof into lengths.

Other objects of the invention will in part be obvious and will in part appear from reference to the following detailed description taken in connection with the accompanying drawings, wherein like numerals identify similar parts throughout, and in which.

Figure 1:
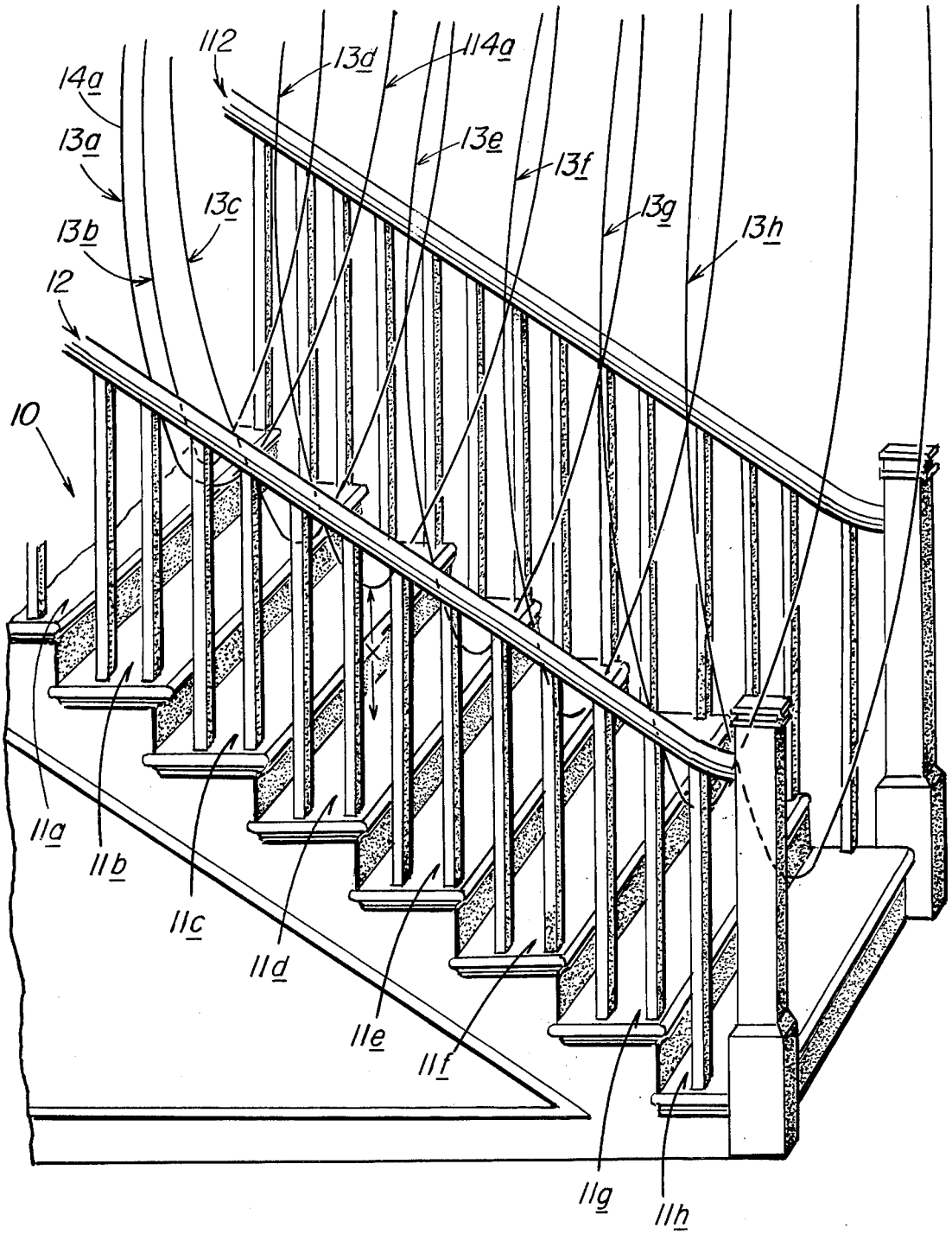
FIG. 1 is a perspective view, with parts broken away, of a staircase defining a stairway with the flight of stairs shown being medially overhung by suitably supported depending loops of the flexible strand.

It will be seen from FIG. 1 that a stairway in a building occupied by people may have a section, such as that indicated at 10 in FIG. 1, with the series of steps shown at 11*a*, 11*b*, 11*c*, 11*d*, 11*e*, 11*f*, 11*g*, and 11*h* being of somewhat similar construction, each surmounted by its horizontal tread and with the latter supporting suitable banisters for carrying side rails 12 and 112 for a person ascending or descending to grasp with one hand for steadying his climbing or descending. This stairway is shown to have mounted therewith, particularly in a central zone of the successive stair-step treads, a series of depending loops 13*a*, 13*b*, 13*c*, 13*d*, 13*e*, 13*f*, 13*g*, and 13*h*, each formed of any suitable flexible strand structure, e.g., cable, rope and the like. It will be noted that each loop is formed by a pair of depending legs, e.g., 14*a* and 114*a*, which are preferably widely spaced longitudinally of the stairway. It will also be noted that the bottoms of the loops are located a relatively short distance "X" from the tread surface immediately therebeneath so that the loops will serve to be readily available to the grasp of person's of various heights including children. For example, such distance from the tread surface to the bottom of the loop immediately thereabove may be about one and one-half feet. It will also be noted that each loop has such relatively widely spaced forward and rearward suspension legs with the forward suspension leg crossing over a plurality of the rearward suspension legs of preceding loops, whereby the number of loops may approach the number of steps while the forward and rearward suspension legs of each at their pair of anchoring top portions are spread longitudinally of the stairway at an appreciably greater distance than the tread width. This assures that the loops are relatively widely open while together providing a plurality of rather closely spaced depending legs to be readily available for easy grasping should a person tend to stumble or slip. It is important that the plane of each loop be substantially longitudinal rather than transverse since, if the latter, such lateral loop could be dangerous as presenting to a person pitching head first down the flight of stairs a threat of an open loop into which his head might enter to grip him about the face of throat.

It will also be noted that the row of successive depending loops preferably extends down within a medial zone so that to each side thereof a clear side zone is provided between the adjacent side rail and such row of depending loops, so as not to interfere with climbing and descending. Thus, whether one descends or ascends one such clear stairway zone he will have on one side the usual hand rail and on the other side a series of rather closely spaced hanging strands or cords for instantaneous seizing to steady himself.

As has been previously indicated, the stairway preferably is provided overhead with some means for suitably supporting the depending loops of strands 13*a*, etc. Many stairways and buildings have stairheads in which a lateral or sloping surface is provided by suitable ceiling structure. A portion of such ceiling structure is indicated at 15 in FIG. 2. The ends of the depending side legs 14 and 114 of such loops are anchored to such overhead ceiling structure or supporting means in any suitable manner. For example, such supporting means may be in the form of an inverted channel 16 to serve as an elongated beam structure and may include an inverted, longitudinal, medial channel portion 17 anchored in any suitable manner to such overhead structure, such as by a series of headed anchor bolts 18, with the depending side edges of the channel turned to provide substantially transverse side flanges 19 and 119.

Figure 2:
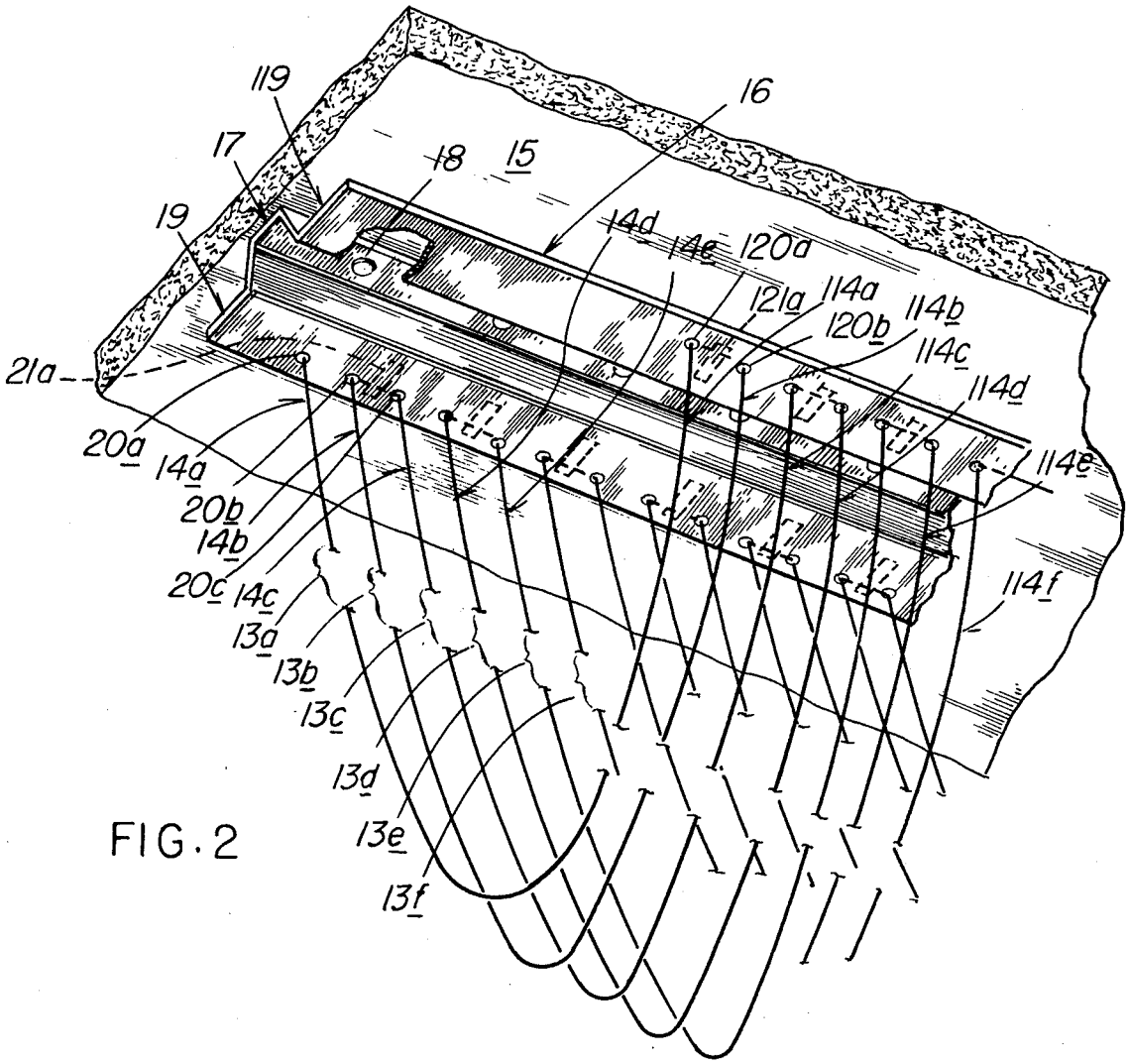
FIG. 2 is a perspective view, with parts broken away and in section, of a series of the depending loops shown in FIG. 1, and illustrating a certain type of anchorage thereof which includes an elongated beam structure fastened to the stairhead.
Figure 3:
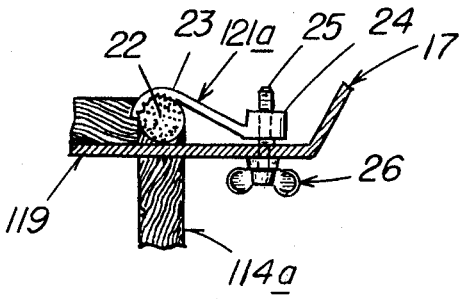
FIG. 3 is an enlarged detail and sectional view of a releasable strand anchorage which may be embodied in the FIG. 2 assembly.

The lateral side flanges 19 and 119 of the inverted support channel 17 are suitably equipped with any of a variety of means to anchor thereto the upper ends of the loop legs 14 and 114. If it is desired to use a single long piece of strand, cord, or rope to provide the successive loops 13 there need be no careful measuring of sections of such strand or rope to cut off pieces of suitable length for providing such loops that will have their turned medial bottom sections suspended above the stair treads at substantially equal distances for attainment of an aesthetic appearance. For example, as is suggested in FIGS. 2 and 3 one end of such long strand or rope section may extend up through a hole 20*a* in one of the channel side flanges 19 for anchorage knotting or receiving above such flange a suitable anchoring device. This first loop 13*a* may then have the top end of its other leg 114*a* extending up through a similar hole 120*a* in the other channel side flange 119 and will then continue along the top surface of the latter to extend down through a nearby hole 120*b* thence to extend downward to provide the strand leg 114*b*. It is indicated in FIG. 2 at 21*a* that between the holes 120*a* and 120*b* the short section of strand 22 (FIG. 3) resting upon the top surface of the side flange 119 is clamped to the latter by any suitable clamping means, such as that shown in detail in FIG. 3, at 121*a*. As is indicated more in detail in FIG. 3 such clamp 121*a* may include a hook-shaped pressure-applying strip 23 having an internally threaded hub 24 through which threadably extends the threaded shank 25 of a wing bolt 26, with this shank extending up through a hole in channel flange 119 (such wing head of this clamping bolt being omitted from FIG. 2 in order to avoid confusion of details). It will further be understood that leg 114*b* of the next loop 13*b* extends from the channel flange hole 120*b* back to the next hole 20*b* in channel flange 19 and thence across to the next hole 20*c* in the latter for application of the clamping action of a similar clamp 21*a* to the section of the strand extending between these holes. Such draping back and forth and clamping anchorage of the sections of the strand or rope thus progressively produces the pattern of the loops illustrated in FIG. 2 and which may, of course, set up the like pattern in FIG. 1. It will thus be understood that with the stairhead surface, and thus the inverted anchorage channel 17 fixed thereto, extending in planes obtuse relative to a plane of the front edges of the stair treads the bottoms of such loops may readily be provided to be disposed in a plane which is parallel to the tread edge plane while being obtuse relative to the overhead structure.

Figure 4:
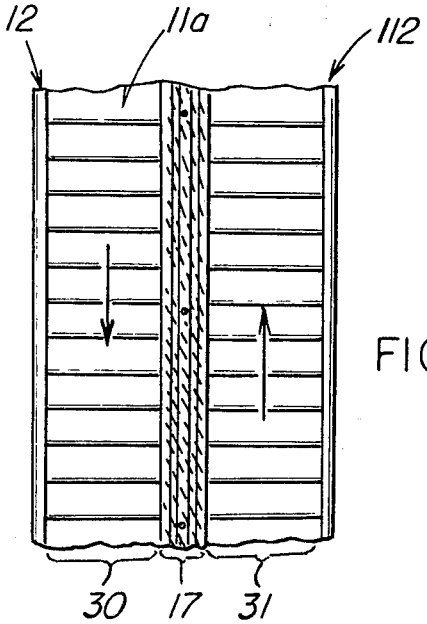
FIG. 4 is a plane view of a smaller scale assembly which may include the structures illustrated in FIGS. 1 and 2, with parts broken away.

The small detail plan view of FIG. 4 provides a readily understandable pattern of the parts of the stairway equipped with the draped loops and the support thereof on the medially located overhead supporting channel 17 with the planes of such successive loops being chiefly directed longitudinally, but at slight angles whereby the legs of each loop may be widely separated at their top end anchorages while assuring that the legs of the successive loops provide relatively closely spaced depending strand or rope sections for ready grasping. It will be seen that such a relative arrangement of the parts provide a clear zone of descent between side hand rail 12 and such assembly of draped loops depending from the anchorage channel 17, as well as a clear zone of ascent 31 between the latter and the other side hand rail 112.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is the novel subjects matter defined in the following claims.

I claim:

1. A stairway safety suspension means comprising, in combination;

1. overhead means extending along the stairway above the flight of stairs;

2. a plurality of depending loops of flexible strand means suspended successively from said overhead means with the bottoms of said loops located above the steps less than the heights of people; and

3. means dictating that the planes of said loops are oriented generally longitudinally along the stairway.

2. The stairway safety suspension means as defined in claim 1 characterized by said dictating means being in the form of means anchoring the pair of top portions of each of said loops.

3. The stairway safety suspension means as defined in claim 2 characterized by said anchoring means for each loop being in the form of a pair thereof which are spaced appreciably longitudinally along said stairway whereby each loop is relatively widely open in its suspended condition.

4. The stairway safety suspension means as defined in claim 3 characterized by said overhead loop suspending means being in the form of elongated beam structure.

5. The stairway safety suspension means as defined in claim 4 wherein said stairway has a stairhead above the flight of stairs with means anchoring said elongated beam structure to said stairhead.

6. The stairway safety suspension means as defined in claim 5 characterized by said beam structure being in the form of an inverted channel structure having its web means anchored to the stairhead, and said pair of anchoring means for each said loop being provided in the pair of opposite side flange means of said channel structure at points spaced appreciably longitudinally along said channel structure.

7. The stairway safety suspension means as defined in claim 4 characterized by said plurality of successive strand loops being in the form of successive sections of said flexible strand means which are integral with each other so that together they form a continuous length of the strand means, said side flange means carrying the pairs of anchoring means in forms inclusive of adjustable clamping means each adapted to fix a section of said strand length to one of said side flange means.

8. The stairway safety suspension means as defined in claim 5 characterized by each said loop having a forward suspension leg and a rearward suspension leg with the forward suspension leg of the major number of middle loops crossing over a plurality of the rearward suspension legs of preceding loops, whereby the number of loops may approach the number of steps while the forward and rearward suspension legs of each at their pair of anchoring top portions are spread longitudinally of the stairway at appreciably greater distance than the tread width.

* * * * *